US005216428A

United States Patent [19]

DuFort

[11] Patent Number: 5,216,428

[45] Date of Patent: Jun. 1, 1993

[54] MODULAR CONSTRAINED FEED FOR LOW SIDELOBE ARRAY

[75] Inventor: Edward C. DuFort, Fullerton, Calif.

[73] Assignee: Hughes Aircraft Company, Los Angeles, Calif.

[21] Appl. No.: 611,059

[22] Filed: May 16, 1984

[51] Int. Cl.[5] ..... H01Q 3/36; H01Q 3/40

[52] U.S. Cl. ..... 342/368; 342/372; 342/373

[58] Field of Search ..... 343/370, 373, 374; 342/370, 373, 374, 368, 369, 427, 372

[56] References Cited

U.S. PATENT DOCUMENTS

| | | | |
|---|---|---|---|
| 3,568,207 | 3/1971 | Boyns et al. | 342/374 X |
| 3,803,624 | 4/1974 | Kinsey | 342/373 X |
| 3,916,417 | 10/1975 | Wong et al. | 342/373 X |
| 4,228,436 | 10/1980 | DuFort | 342/370 |
| 4,246,585 | 1/1981 | Mailloux | 342/373 |
| 4,499,471 | 2/1985 | Luh | 342/373 |
| 4,503,434 | 3/1985 | Luh | 342/373 |
| 4,766,437 | 8/1988 | Schmidt et al. | 342/368 |
| 4,849,763 | 7/1989 | DuFort | 342/372 |

*Primary Examiner*—John B. Sotomayor
*Attorney, Agent, or Firm*—Wanda K. Denson-Low

[57] ABSTRACT

A modular feed system for a phased array antenna is disclosed. Several contiguous radiative elements in a row (or column) are grouped together by a module network to form a linear array module having two inputs. Excitation of one input produces a constant even distribution at the module output, while excitation of the second input produces a linear odd distribution. The module is adapted to approximate both the average value as well as average slope of a segment of an ideal linear array distribution. A network interconnects a plurality of modules to provide independent sum and difference distributions producing low array pattern sidelobes.

30 Claims, 10 Drawing Sheets

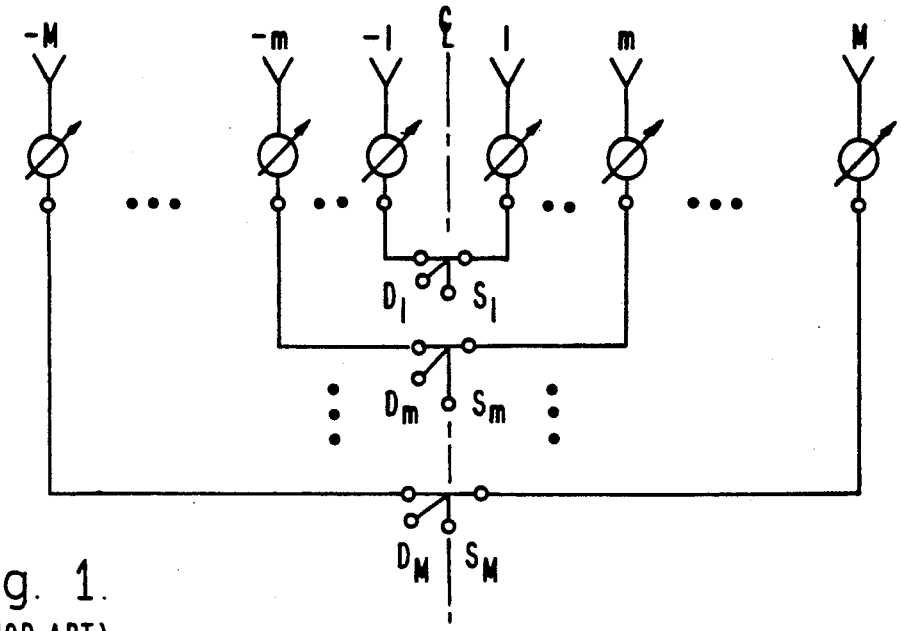
Fig. 1.
(PRIOR ART)
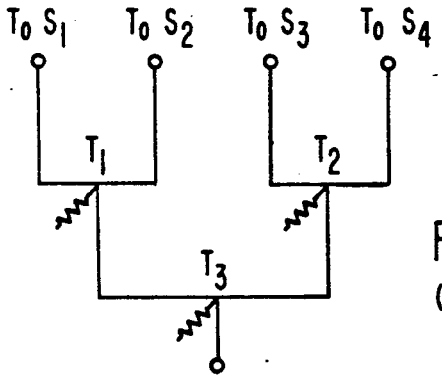
Fig. 2.
(PRIOR ART)
Fig. 3.
(PRIOR ART)
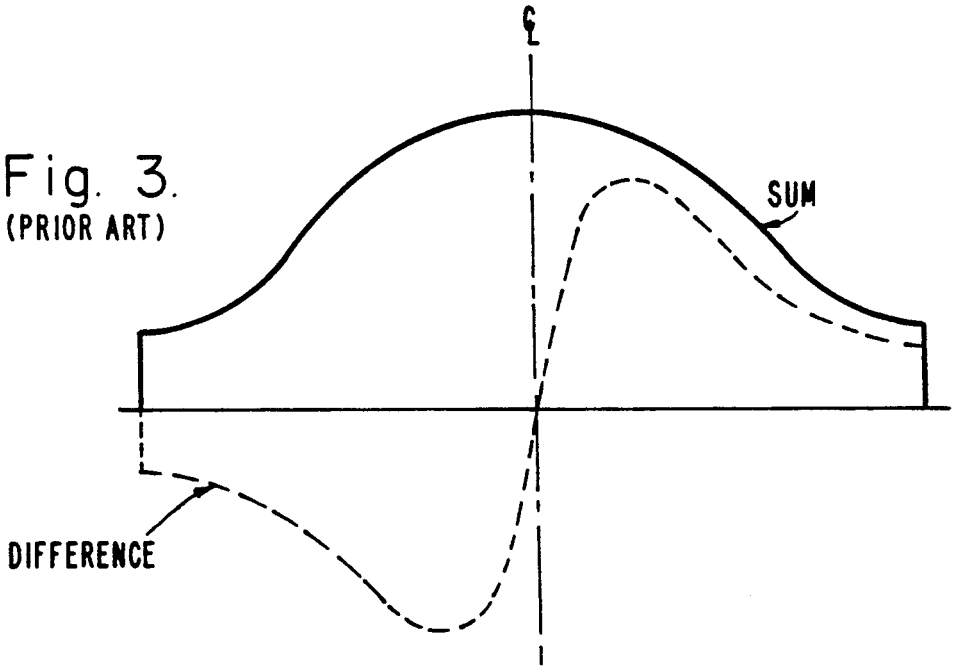

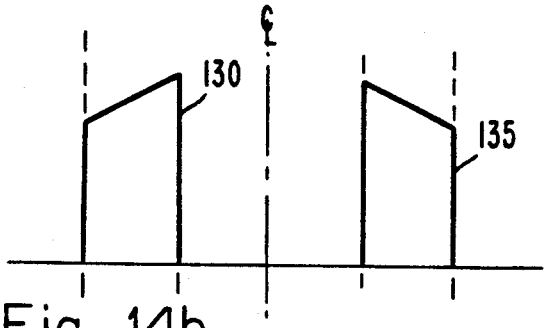
Fig. 14b.
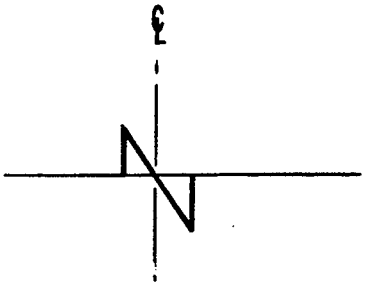
Fig. 15a.
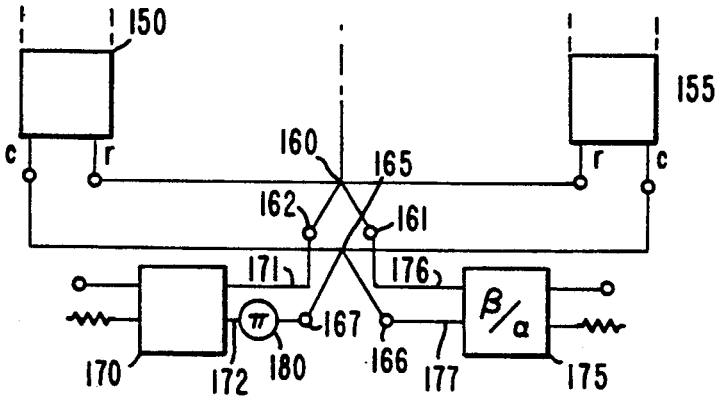
Fig. 14c.
Fig. 15b.
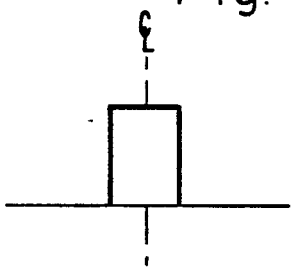
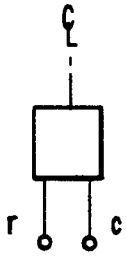
Fig. 15c.
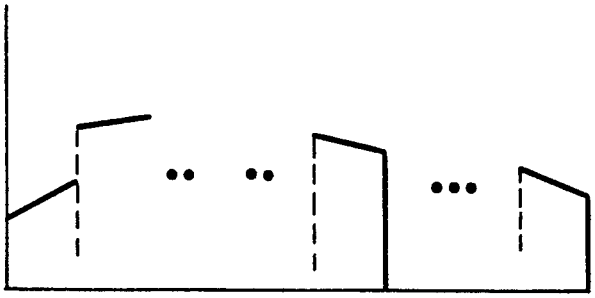
Fig. 16.

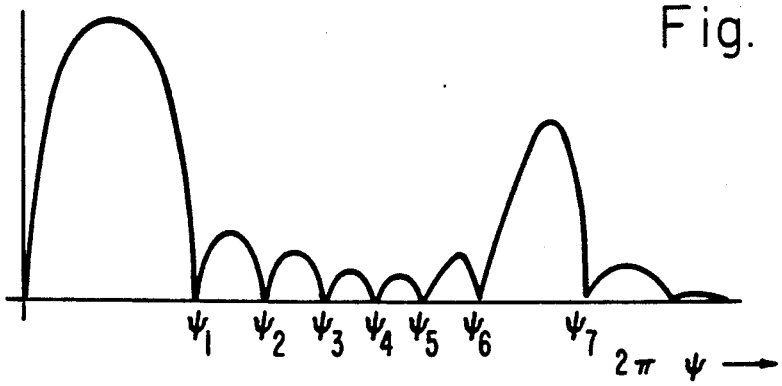
Fig. 17.
Fig. 19a.
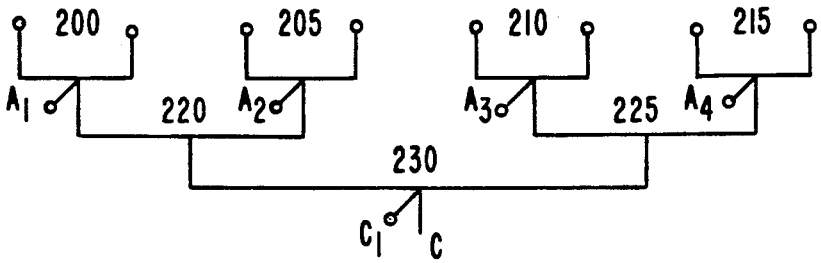
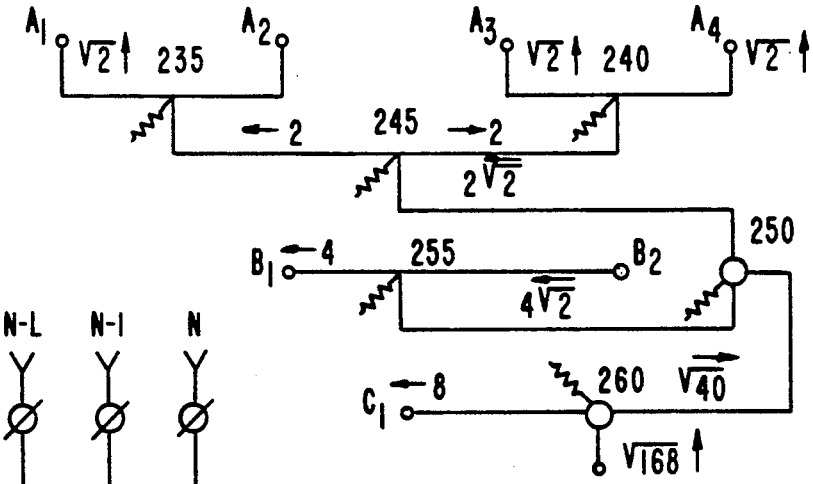
Fig. 19b.
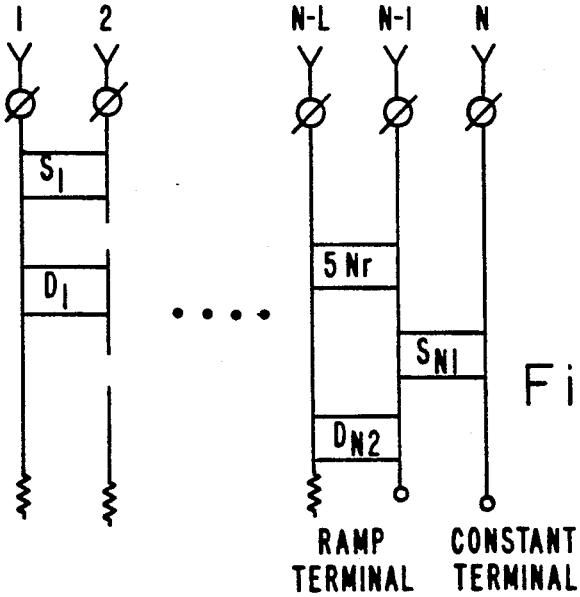
Fig. 18.

GL<
RELATIVE POWER IN dB
0
-10
-20
-30
-40
-50
0
1
2
3
4
5
6
7
8
9
2π
d sin θ in RADIANS GL<
RELATIVE POWER IN dB
0
-10
-20
-30
-40
-50
0
1
2
3
4
5
6
7
8
9
π
d sin θ in RADIANS

MODULAR CONSTRAINED FEED FOR LOW SIDELOBE ARRAY

BACKGROUND OF THE INVENTION

1. Field of the Invention

The field of the present invention is phased array antenna systems and, more particularly, modular-type feed systems.

2. Description of the Prior Art

A typical pencil beam phased array radar antenna may contain 4,900 radiating elements and phase shifters. The usual corporate-type sum/difference feed system for this array would require 70 cables and 140 connectors per row of 70 elements plus additional cables and couplers to form the row sum and difference feeds. Thus, more than 2,450 Magic T devices, 4,900 cables and 9,800 connectors are required.

A typical dual corporate feed for providing independent sum and difference beams in a linear array is shown in FIG. 1. Element pairs which are symmetrically located about the center line of the array are connected to the respective side arms of a Magic T device. The sum terminals [$S_1 \ldots S_m \ldots S_M$] of the M Magic T devices are interconnected through another corporate feed to form the sum distribution which is symmetrical (as a consequence of using the sum terminal of the Magic T, but otherwise arbitrary. A typical sum forming network for connection to the sum terminals $S_1 \ldots S_4$ of the Magic T devices is shown in FIG. 2 for $M=4$.

Since the Magic T devices ($T_1 \ldots T_{M-1}$) in the sum forming network have arbitrary coupling values, the aperture distribution at the radiating elements is arbitrary except for symmetry about the center line. A network similar to that of FIG. 2, but with another arbitrary set of Magic T devices, is used to connect the difference terminals [$D_1 \ldots D_n \ldots D_{M-1}$] in FIG. 1. Since the radiating elements fed by the device are difference terminals, the aperture distribution is arbitrary except for antisymmetry about the center line.

The sum and difference distributions are independent in this known approach, and typical forms are shown in FIG. 3. The ideal Taylor 40 dB sum pattern for a 64-element linear array whose elements are spaced apart by one-half wavelength distances is shown in FIG. 4.

This known corporate feed arrangement is an ideal network for realizing low sidelobes for both the sum and difference patterns because it allows the usage of the maximum number of degrees of freedom available, i.e., $M-1$ degrees of freedom for the sum pattern and $M-1$ degrees of freedom for the difference pattern in an array of 2M elements. This network, however, is not ideal from an implementation point of view. Each element requires an interconnecting cable and two connectors. Large cables are preferred to reduce ohmic loss; consequently, a very complex packaging problem must be solved. The cost of cable rawstock, connectors, bending and threading the cables through the antenna array support structure, cutting to electrical length and testing becomes oppressive for large phased arrays. Thus, while this feed admittedly provides the greatest freedom of choice for the sum and difference patterns, the cost and complexity often are prohibitive.

A simpler, prior art technique consists of feeding the radiating elements together in groups to form larger output modules instead of independently feeding each element as in FIG. 1. The modules or subarrays are assumed to be identical and to contain N uniformly illuminated elements. A typical pair of modules symmetrically located about the center of the array are connected together by a Magic T device as shown in FIG. 5. As before, terminals $S_m$ are interconnected to form the sum pattern, and terminals $D_m$ are interconnected to form the independent difference pattern. The principal advantage of this modular approach is that there are far fewer cable connectors and subassemblies.

Although the sum and difference distributions are independent, the number of degrees of freedom has been reduced to $M/N-1$ for the sum pattern and $M/N-1$ for the difference pattern (if $N=1$, the modular feed is the same as the ideal case shown in FIG. 1). Typical aperture amplitude distributions are stepped or quantized as shown in FIG. 6, where the amplitude is constant across a group of N contiguous elements. If these steps are fitted to the ideal Taylor distribution illustrated in FIG. 4, the resultant pattern for a 64-element modular array with 8 elements per module will be as shown in FIG. 7. The sidelobe level has been seriously degraded from $-40$ dB to $-24$ dB for the close-in lobe and the remote sidelobes also remain high at typically $-34$ dB. High sidelobes generally occur near "grating lobe" positions sine $\theta = l\lambda/d$, where $l=\pm 1$, etc., and d is the subarray length. These grating lobe positions are caused by the discontinuities or steps in the aperture distribution resulting from the modular feed, and are analogous to lobe positioning caused by a grating. Thus, the usual equi-amplitude modular array is simpler and more economical than the ideal feed, but the performance degradation often is unacceptable.

It is therefore a principal object of the present invention to provide an array feed system which greatly reduces cost and complexity, yet sacrifices little in sidelobe performance of the resultant radiation patterns.

Yet another object of the invention is to provide a modular feed system adapted to approximate both the desired amplitude and desired slope at the module output.

It is yet another object to provide a modular feed system whose component costs are minimized as a result of substantial use of identical components.

A further object of the invention is to provide a modular feed system whose testing cost is reduced because identical modules may be used which require testing only at the modular level.

It is another object of the invention to provide a modular feed system wherein the number of cables and connectors are reduced, thereby reducing parts costs, as well as facilitating assembly of the feed system into the array backup structure.

SUMMARY OF THE INVENTION

The present invention is a modular phased array feed system having independent sum and difference patterns which approximate the ideal patterns to a high degree of accuracy. Several contiguous radiating elements in a row (or column) are grouped together by a network of hybrid couplers to form a linear array module with two inputs. The module has integrated phase shifters and radiating elements. One input terminal produces a constant, even distribution at the output, and the second input produces a linear, ramp-type, odd energy distribution. This module approximates both the average aperture distribution value as well as the average slope of a segment of an ideal linear array distribution. A network to interconnect the modules provides independent sum and difference distributions which produce low sidelobes. The resulting system is far simpler than the ideal network, realizing substantial savings in cost and complexity, yet the performance closely approximates the ideal array distribution.

Other features and improvements are disclosed.

BRIEF DESCRIPTION OF THE DRAWINGS

The various objects, features and advantages of the disclosed invention will be readily appreciated by persons skilled in the art from the following detailed disclosure when read in conjunction with the accompanying drawings, wherein:

FIG. 1 represents a simplified schematic of a prior art dual corporate feed system.

FIG. 2 represents a simplified schematic of a typical prior art sum pattern forming network used in conjunction with the corporate feed system of FIG. 1.

FIG. 3 is a graph illustrating the typical sum and difference aperture energy distributions which may be achieved using the prior art corporate feed systems illustrated in FIGS. 1 and 2.

FIGS. 14*a* and 14*b* are graphs depicting respectively the aperture difference and sum distribution segment pairs near the distribution center axis to be approximated by a pair of modules in accordance with the present invention.

FIG. 14*c* is a simplified schematic diagram illustrating the module pair and circuit for approximating the difference and sum aperture distribution segments of FIGS. 14*a* and 14*b*.

FIGS. 15*a* and 15*b* are graphs depicting respectively the aperture difference and sum distribution segment at the distribution center axis to be approximated by a module in accordance with the present invention.

FIG. 15*c* is a simplified schematic diagram illustrating the module for approximating the sum and difference aperture distribution segments of FIG. 15*a* and 15*b*.

FIG. 16 is a graph illustrating one-half of an odd difference aperture distribution comprising broken line segments resulting from 2N modules in accordance with the present invention.

FIG. 17 is a graph illustrating the relative power pattern of the array when N is four, i.e., for eight modules.

FIG. 18 is a schematic of a first preferred embodiment of a module circuit comprising a dual series feed circuit.

FIGS. 19*a* and 19*b* are schematics illustrating a second preferred embodiment of a module circuit, depicting respectively the two layers of a two-layer module circuit, predominantly utilizing equal power splitter devices.

DETAILED DESCRIPTION OF THE INVENTION

The present invention comprises a novel phased array feed system. The following description of the invention is provided to enable any person skilled in the art to make and use the invention. Various modifications to the disclosed embodiment will be readily apparent to those skilled in the art, and the generic principles defined herein may be applied to other embodiments. Thus, the present invention is not intended to be limited to the embodiments shown, but is to be accorded the widest scope consistent with the principles and novel features of the invention.

In a broad sense, the invention comprises a system for approximating the ideal aperture power distribution of a phased array antenna system. Unlike the known prior art systems employing modules, which provide a uniform power distribution for each of the array elements driven by the module, the invention employs modules which approximate not only the mean value of a segment of the power distribution, but also the slope of the distribution. As a result, the levels of the undesired sidelobes of the antenna array fed by the modular feed system of the present invention are substantially diminished in comparison with the prior art modular feed systems.

1. The Module as a Black Box

It is known that a two-dimensional array can be constructed by stacking linear arrays; therefore, for clarity the discussion of the preferred embodiment is confined to the linear case.

Figure 8A:
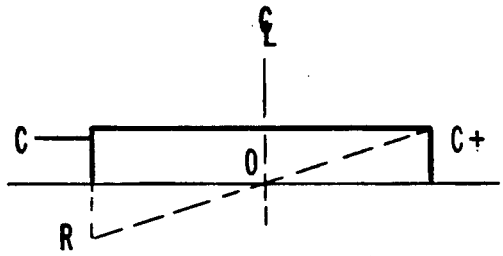
FIGS. 8*a* and 8*b* are simplified schematic illustrating an exemplary array module in accordance with the present invention.
Figure 8B:
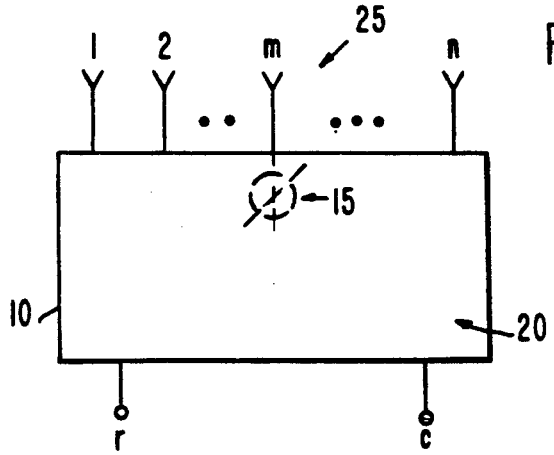

The array of 2NM elements is comprised of 2M modules each of N elements. An exemplary module 10 is shown in the simplified schematic of FIG. 8*b*. Each module has two inputs: (1) terminal c provides a constant, output C, which is even in the sense that the signal is of the same polarity over its distribution, (2) terminal r provides a ramp, output R, which is odd in the sense that the polarity is of different signs about the center line of the distribution segment, i.e., the ramp output is negative in polarity on the left, or negative side of the center axis of the distribution, goes through zero amplitude at the center axis, and is of positive polarity on the right side of the center axis of the distribution. The constant output C and the ramp output R are depicted in FIG. 8*a*. The module is preferably constructed with integral radiating elements 25, phase shifters 15 and a network 20 (not shown in FIG. 8*b*) necessary to produce the C and R distributions.

The output distributions C and R produced by exciting terminals c and r respectively with unit inputs are given by Equations 1 and 2.

$$c_n = 1/\sqrt{N} \tag{1}$$

$$r_n = \left(n - \frac{N+1}{2}\right)/\sqrt{\frac{N(N^2-1)}{12}} \tag{2}$$

Equations 1 and 2 assume that energy is conserved, as shown in Equation 3.

$$\sum_1^N c_n^2 = 1 \qquad \sum_1^N r_n^2 = 1 \tag{3}$$

It is noted that the distribution $c_n$ is constant and even, whereas the distribution $r_n$ is linear in n and odd. These distributions are orthogonal in the sense shown in Equation 4, with the result that both distributions can be realized without loss.

$$\sum_1^N c_n r_n = 0 \tag{4}$$

With N=4, for example, the distributions are given by Equations 5*a* and 5*b*.

$$C = \begin{matrix} 1/2 \\ 1/2 \\ 1/2 \\ 1/2 \end{matrix} \tag{5a}$$

$$R = \begin{matrix} -3/\sqrt{20} \\ -1/\sqrt{20} \\ 1/\sqrt{20} \\ 3/\sqrt{20} \end{matrix} \tag{5b}$$

When terminals c and r are both excited by inputs $\alpha$ and $\beta$, respectively, the net output vector of the module is trapezoidal with the slope either positive or negative depending on the sign of $\beta$. This function may be used to approximate an arbitrary distribution $z_n$ as shown in Equation 6.

$$z_n = \alpha c_n + \beta r_n + (\textit{other terms orthogonal to C and R}) \tag{6}$$

Since a purpose of the invention is to approximate a known aperture distribution, it is necessary to determine the required values of the inputs and necessary to obtain, or approximate the desired aperture distribution. One method of determining the inputs is shown in FIGS. 8*a* and 7*b*.

Since C and R are orthonormal, which follows from the relationships of Equations 3 and 4, $\alpha$ may be found by multiplying Equation (6) by $r_n$ and summing over the number of modules. The coefficient $\beta$ is found in a similar way, i.e., by multiplying Equation 6 by $c_n$ and summing over M.

$$\sum_1^M c_n z_n = \alpha \tag{7a}$$

$$\sum_1^M r_n z_n = \beta \tag{7b}$$

This method of determining $\beta$ and $\alpha$ provides a least square error fit to $z_n$, and is exact if $z_n$ is trapezoidal. It is noted that, for the prior art module described above, $\beta=0$; therefore, the error in fitting $z_n$ is less for the present invention because the two dominant components of $z_n$ may be accurately represented. The description of the network 20 within the module 10 is described in further detail hereinbelow.

2. Interconnection of the Modules for the Sum Distribution

Figure 9:
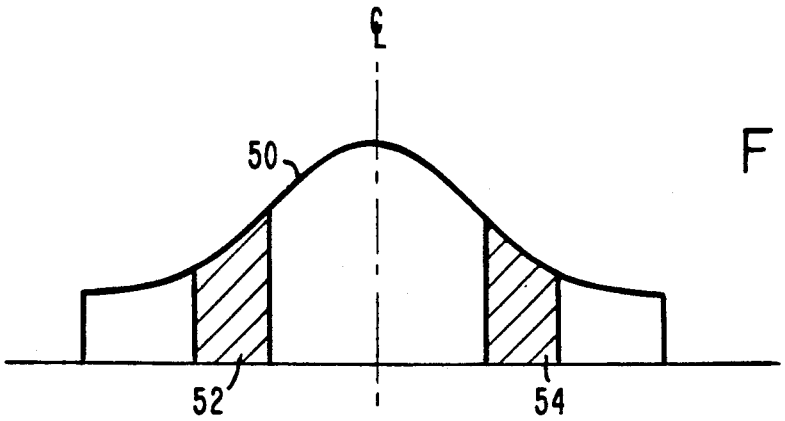
FIG. 9 depicts a typical ideal aperture sum distribution and corresponding segments of the distribution to be approximated by a pair of modules in accordance with the present invention.

A typical sum distribution 50 about the array center line is indicated in FIG. 9 with a symmetrical pair of corresponding segments 52,54, which may be approximated by trapezoidal distributions in accordance with the present invention.

Figure 10A:
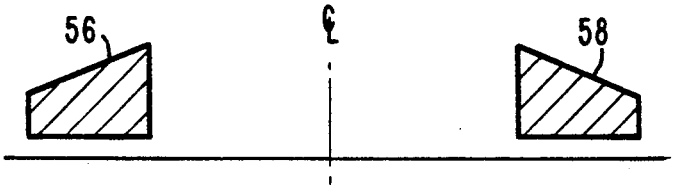
FIGS. 10*a* and 10*b* are a simplified schematic illustration of the network for interconnection of corresponding left and right modules in accordance with the present invention.
Figure 10B:
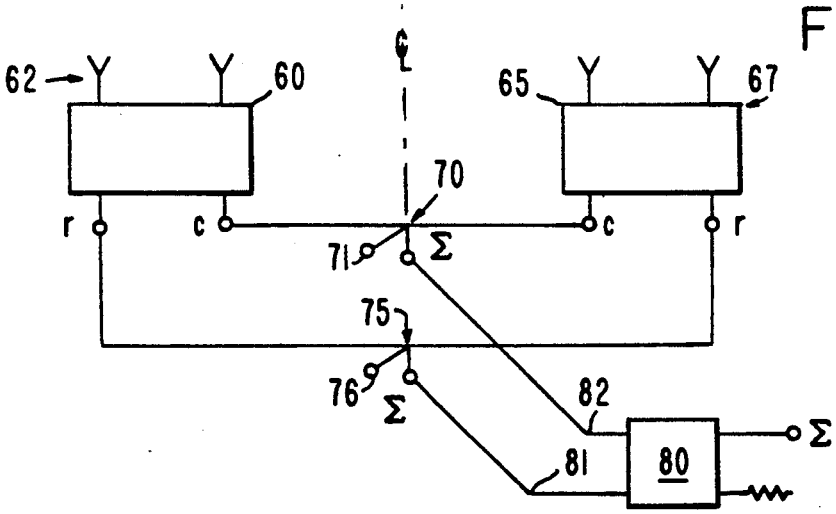

The symmetrical trapezoidal distributions 56,58 of FIG. 10*a* correspond to the segments 52,54 of FIG. 9. The module interconnection necessary to generate the trapezoidal distributions is illustrated in FIG. 10*b*. The left module 60 is shown in the nominal orientation necessary for the left segment; however, the right module 65 is connected in an inverted orientation, i.e , the location of the module array elements in relation to the center line is reversed, in order to provide the negative slope when excited by the same excitation signal as the left module 60. The two modules are in other respects identical.

The respective c and r terminals of the left and right modules 60,65 are interconnected through the side arms of respective Magic T devices 70,75. Magic T devices are well-known to those skilled in the art. When power is fed into the sum port of the four port device, and the two device side arm ports are terminated in matched loads, the power is divided equally between the two side arm ports of the Magic T device. When power is fed into the device difference port, the power is divided evenly but 180° out-of-phase between the two side arm ports.

The sum terminals of two Magic T devices 70,75 are excited by another coupler 80 adapted to produce the correct ratio $\beta/\alpha$. Thus, the input voltage to coupler 80 is divided between the side arms 81,82 in the ratio $\beta/\alpha$.

This coupler 80 can be chosen to produce a trapezoidal approximation to the left segment 52 in FIG. 9 with $\beta$ and $\alpha$ both positive. The right segment is a symmetrical image of the left; therefore, the inverted module produces the desired symmetrical result.

Figure 11:
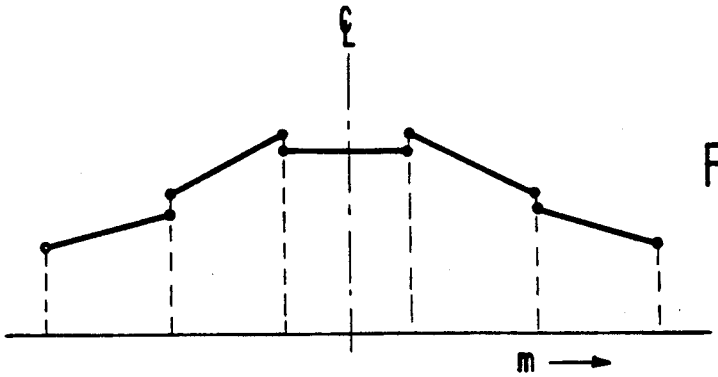
FIG. 11 is a graph of the trapezoidal approximation to the aperture sum distribution which is formed by five modules in accordance with the present invention.

Similar interconnections are made for other module pairs symmetrically disposed about the array center line. The sum input terminals of all the couplers are connected to a corporate feed to complete the approximate sum amplitude distribution in the form of trapezoids as shown in FIG. 11 for five modules.

Instead of using the least square criterion to develop the approximation, sample points of the continuous distribution can be taken and the $\beta/\alpha$ ratios then chosen to form a continuous approximation, i.e., an approximation wherein there are no discrete steps between adjacent module outputs. By this technique, the mean value of the distribution is achieved exactly, and the ramp values are then adjusted so that there is no step discontinuity. The continuous distribution will produce lower far-out sidelobes; however, lower near-in sidelobes (near the main beam) are produced by the discontinuous forms shown in FIG. 11.

3. Interconnection of the Modules for the Difference Distribution

Figure 12:
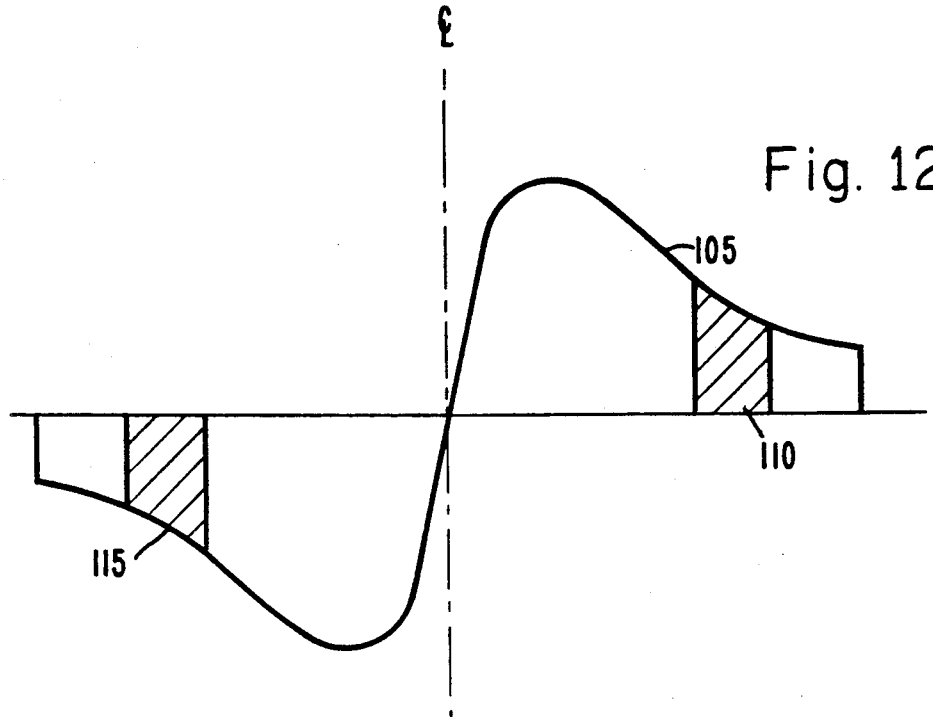
FIG. 12 depicts a typical ideal aperture difference distribution and a corresponding segment pair to be approximated by a pair of modules in accordance with the present invention.

A typical difference (asymmetrical) distribution 105 and two asymmetrical segments 110,115 near the edges of the distribution are shown in FIG. 12. The slope and mean value have the same sign on the left segment 115; therefore, a positive $\beta/\alpha$ ratio is required as in the case of the sum distribution approximation. It is also desired that the right segment be an antisymmetrical image of the left segment.

Figure 13A:
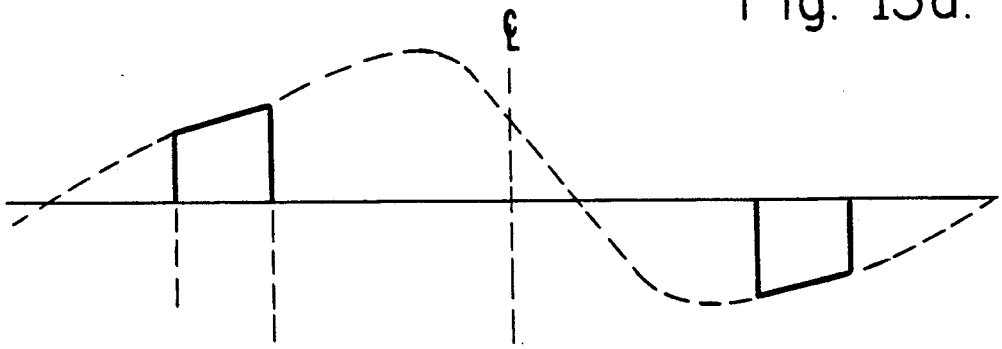
FIGS. 13*a* and 13*b* are graphs respectively depicting the aperture difference and sum distribution segment pairs to be approximated by a pair of modules in accordance with the present invention.
Figure 13B:
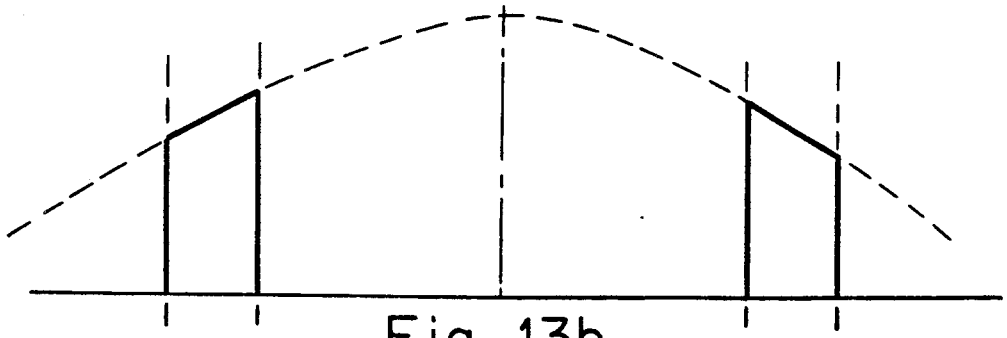
Figure 13C:
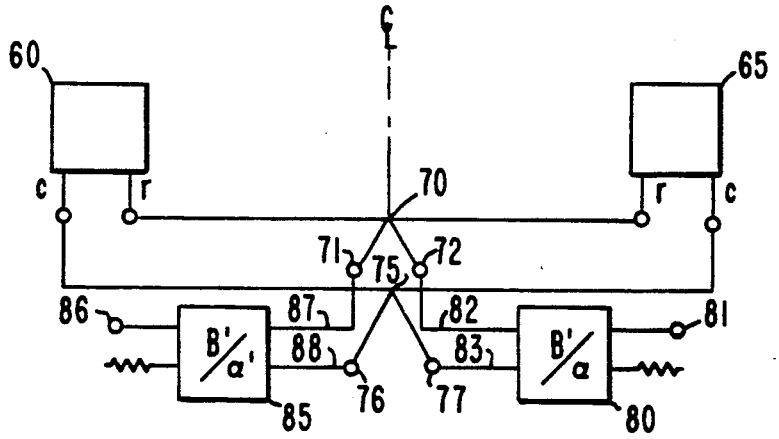
FIG. 13*c* is a simplified schematic diagram illustrating the module pair and circuit for approximating the difference and sum aperture distribution segments of FIGS. 13*a* and 13*b*.

These objectives are realized in the preferred embodiment by connecting the difference ports 71,76 of the Magic T devices 70,75 of the circuit shown in FIG. 10*b* to a coupler 85 which produces a ratio $\beta'/\alpha'$ not necessarily the same magnitude as the ratio $\beta/\alpha$ for the corresponding sum segment pair, but of the same positive sign. The required circuit is shown in FIG. 13*c*; the respective difference and sum segment pair of the distributions produced by the circuit are shown in FIG. 13*a* and 13*b*, respectively, As in FIG. 10*b*, modules 60,65 have respective c and r input terminals, the c terminals being coupled to the side arm ports of Magic T device 75. The sum ports 72,77 of the Magic T devices are coupled to the respective side arm ports 82,83 of coupler 80. The input signal is provided to coupler 80 at input terminal 81; the other input terminal is terminated in a matched load. Coupler 80 is adapted to split the input signal power between output ports 83,82 in a ratio equivalent to $\beta/\alpha$.

The difference ports 71,76 of Magic T devices 70,75 in turn are coupled to the respective output ports 87,88 of coupler 85. The input signal is provided to terminal 86 of coupler 85; the other input port of coupler 85 is terminated in a matched load. Coupler 85 is adapted to split the input power received at input terminal 86 between output ports 88,87 in a ratio equivalent to $\beta'/\alpha'$.

Figure 14A:
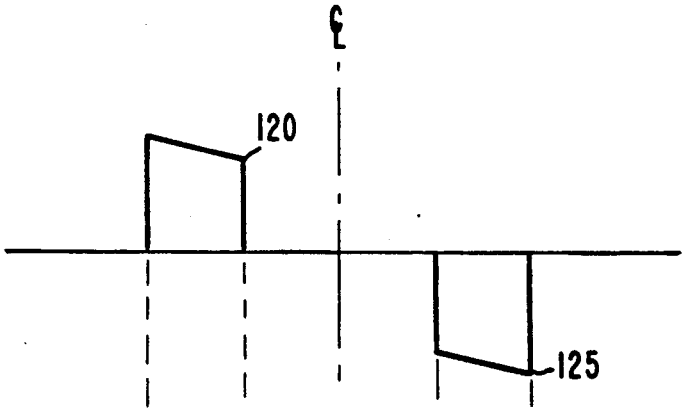

Referring now to FIGS. 14*a*, 14*b* and 14*c*, the approximation of the segment pairs near the center of the respective difference and sum distributions is illustrated. The anti-symmetrical difference segment pair 120,125 is illustrated in FIG. 14*a*, and the symmetrical sum segment pair 130,135 is illustrated in FIG. 14*b*. The respective c and r terminals of module pair 150,155 are fed by the respective side arm ports of Magic T devices 160,165, as illustrated in FIG. 14*c*. Coupler 170 comprises the difference distribution coupler with a coupling ratio (between its output ports 172,171) of $\beta'/\alpha'$. The output ports of coupler 170 feed the respective difference ports 162,167 of Magic T devices 160,165.

Coupler 175 comprises the sum distribution coupler with a coupling ratio (between its output ports 177,176) of $\beta/\alpha$; the output ports of coupler 170 in turn feed the respective sum ports of Magic T devices 160,165.

It may appear at first glance that a difficulty arises for module pairs near the center axis of the distributions. Near the center of the distribution, the left segment of the sum has a positive slope-to-mean-value ratio (see FIGS. 9, 14*b*), and hence a positive $\beta/\alpha$ ratio. However, near the center of the difference distribution (see FIGS. 12, 14*a*), the left difference segment has a negative slope-to-mean-value ratio and, therefore, a negative $\beta/\alpha$ ratio. On the other hand, these respective ratios have the same sign for segment pairs near the outer edges of the distribution. This difficulty is overcome by placing a fixed 180° phase shift device 180 between the output port 172 of coupler 170 and its connection to the difference port 167 of Magic T device 165.

If the linear array has an odd number of modules, there will be a center module bisected by the array center line, as illustrated in FIGS. 15*a*, *b* and *c*. In this case, only the c terminal of the center module 185 is needed for the sum pattern because it is symmetrical, and only the r terminal of module 185 is needed for the difference pattern because it is asymmetrical. In this case, the $\beta'/\alpha'$ type coupler is not required as shown in FIG. 15.

The circuit for the liner array is completed by connecting all the sum terminals of the module pairs (and the sum terminal of the center module, if there is one) with an appropriate corporate feed necessary to produce the trapezoidal sum approximation. Similarly, the difference terminals are connected in a separate corporate feed. Since these two corporate feeds are separate, and the $\beta/\alpha$ and $\beta'/\alpha'$ couplers are separate, independent sum and difference distributions can be generated. Corporate feed networks per se are well known to those skilled in the art, and need not be described in further detail.

It will be apparent to those skilled in the art that the starting point in the fabrication of a modular feed system in accordance with the present invention is to select the desired or ideal sum and difference distributions. A desired sum distribution for many applications is the well-known Taylor 40 dB amplitude distribution, and a desired difference distribution is the Bayless 40 dB continuous difference distribution.

The above-described technique of fitting straight line segments to known continuous distributions to produce a desired sidelobe level works well for the sum distribution. For many applications, however, the technique may produce unacceptable results, specifically undesirable sidelobe level, for the difference distribution. A rapidly converging trial technique for determining the appropriate modular coefficients has been developed and is described.

The radiation pattern E(u), due to an odd difference distribution ($A(x)=-A(-x)$) on an aperture of length D, is given by Equation 8.

$$E(\psi) = \int_{o}^{D/2} A(x)\sin(ux)dx \quad (8)$$

In the present case, the modules of the present invention produce the odd distribution or broken straight line segments as illustrated in FIG. 16. For the case illustrated, there are 2N modules, and only half the aperture distribution is illustrated. The integral for E ($\psi$) can be expressed as shown in Equation 9:

$$E(\psi) = \sum_{1}^{N} A_{2M-1}(\alpha_n + \alpha_m) - A_{2M-2}(\alpha_n - \alpha_m) \quad (9)$$

$$\text{where } \alpha_n = \sin\left(M - \frac{1}{2}\right)\psi\left(\frac{\sin\psi/2}{\psi/2}\right)$$

$$\alpha_n = \left(\frac{\sin\psi/2}{\psi/2} - \cos\left(\frac{\psi}{2}\right)\right)\frac{\cos(n-1/2)}{\psi/2}\psi$$

$$\psi = wh.$$

When the values for A(m) are specified, the pattern for N =4 typically will have the characteristics shown in FIG. 17. The guiding rule for determining the value for $\beta,\alpha$ is that a sidelobe can be reduced by moving the corresponding interval between the distribution pattern zeros closer together. For four modules, there are eight values of A, any one of which may be set to unity. The seven independent A parameters produce seven zeros at $\psi$1, $\psi$2 . . . $\psi$7 as shown in FIG. 17. There is always a zero at $\psi=0$, and a zero may be placed at $\psi=2\pi$ (where on $\alpha_n=0$ and $\alpha_n=-1\pi$) by requiring the relationship of Equation 10.

$$\sum_{1}^{N} A_{2M-1} = \sum_{1}^{N} A_{2M-2} \quad (10)$$

As a starting point, flat segments are chosen, i.e., $A_{2n-1}=A_{2n-2}$; then $\psi_7=2\pi$, and the other values of A may be chosen to be sample points on a half sine wave. The pattern is then calculated from the expression for E($\psi$) in Equation 8.

For a second trial, $\psi$ is fixed, and $\psi_2 \ldots \psi 6$ are placed at uniform intervals between $\psi 1$ and $\psi_7=2\pi$. The corresponding values of A are found from the linear equations in the seven unknowns $A_o$ . . . $A_6$ (by choice, $A_7=1$) arising from the seven equations $E(\psi_M)=0$, n=1 to 7.

The remaining trials comprise the steps of calculating the pattern and perturbing the zero locations, with the cycle being repeated to reduce the highest sidelobe until the magnitudes of all sidelobes to $\psi=2\pi$ are equal. The result is the optimum that can be achieved with the specified number of modules. Further sidelobe reduction requires additional modules.

Since the line segments forming the distribution are known, the coupler values $\alpha',\beta'$ can then be readily calculated. The value of $\alpha'$ for each segment comprises the mean value of the line segment, and the value of $\beta'$ comprises the slope of the line segment.

4. Circuit within the Module

Since the distributions C and R are themselves sum and difference distributions, they can be produced by the general network described in the prior art (see FIGS. 1-7). The circuit is easily realized in coaxial line components, but cost may be high. This circuit also is difficult to build economically in stripline because multilayers and many wire crossovers are necessary.

A second embodiment is to use a planar dual series feed circuit. This is shown schematically in FIG. 18. Series feed circuits are known in the art, for example, the paper "Monopulse Network for Series Feeding an Array Antenna," Alfred R. Lopez, *IEEE Transactions* AP-16, No. 4, July 1968, page 436 et seq. Couplers $S_1$ . . . $S_{N-1}$ are used to form the sum or constant distribution C, and couplers $D_1$ . . . $D_{N-2}$ are used to form the difference or R distribution (where the latter coupler values are chosen to account for the scattering of couplers $S_1$ . . . $S_{N-1}$). Coupler $S_i$ and $D_i$ are typical hybrid couplers. When one input arm is excited, and the other arm is loaded, the excitation power splits between the two side arm ports in a ratio determined by the hybrid coupling values. The ramp excitation terminal r could as well comprise the left-most input terminal of difference coupler $D_1$.

The circuit of FIG. 18 is a standard circuit drawn in planar form and is suitable for production in stripline. The very tight coupling values required are difficult to build at the present state of the coupler art; however, a cascade of two couplers can be used to achieve the right coupling such as that required for $S_{N-1}$, for example, two 3 dB couplers yield 100% coupling. In cases where the design is practical, the production cost of forming the circuit is relatively low regardless of the circuit complexity because the circuit is formed in a single etching process.

In another embodiment, a two-layer circuit is used to form the module circuit. The first layer uses only typical 3 dB Magic T devices to form the sum distribution C. The difference arms of the Magic T devices are isolated when terminal c of the module is excited and these difference arms may be connected together in a second corporate feed disposed in a second layer to form the R distribution. Most of the couplers in the second layer also will be 3 dB Magic T devices (due to the constant slope of the ramp function); therefore, the R network is easily realized as a second planar circuit. The circuits may be etched separately and then permanently joined using rf interconnects or rf feedthroughs.

A two-layer circuit for an eight element module is illustrated in FIGS. 19*a* and 19*b*. The terminals $A_1$ . . . $A_4$, $B_1$, $B_2$ and $C_1$ comprise the difference arms of Magic T devices 200, 205, 210, 215, 220, 225 and 230. The side arm ports of Magic T devices 200, 205, 210 and 215 are each respectively coupled through a phase shifter device to one of the eight radiative elements of the module.

The difference arm terminals of the Magic T devices shown in FIG. 19*a* are interconnected by other T junction devices disposed in the second layer of the circuit, as illustrated in FIG. 19*b*. This layer comprises a corporate feed network adapted to produce the ramp or difference distribution. Because the slope of the ramp distribution is constant, T junction devices 235, 240, 245 and 255 comprise equal power split T devices. Devices 250 and 260 comprise unequal power split T devices.

The operation of the circuit may be illustrated by assuming that the r terminal of the module is coupled to an input signal of $\sqrt{168}$ volts. The voltage at the various nodes and the direction of power flow is indicated in FIG. 19*b*. Coupler 260 comprises a −6.23 dB coupler, and coupler 250 comprises a −7.00 dB coupler. Couplers 235, 240, 245 and 255 all comprise −3 dB couplers, i.e., providing equal power splits.

The couplers illustrated in FIG. 19*b* are relatively simple to fabricate, since the coupling values are moderate, and the impedance levels in the coupler circuit are practical. Moreover, the circuit is relatively frequency insensitive. Each of the couplers has an unused terminal which is loaded. The couplers could be replaced by simple reactive T devices if the design is well matched and/or the required bandwidth is narrow.

There are many other possible circuits, which are combinations of series and parallel connections of hybrids, all functionally the same, and all employing 2N−3 couplers. The circuit choice is based on economic considertions, the state of the component art, and the available manufacturing techniques. For large modules, it is believed that a two-layer corporate feed, as described in FIG. 19*a* and 19*b*, is the best choice at the present time.

5. Performance Comparison

Figure 20:
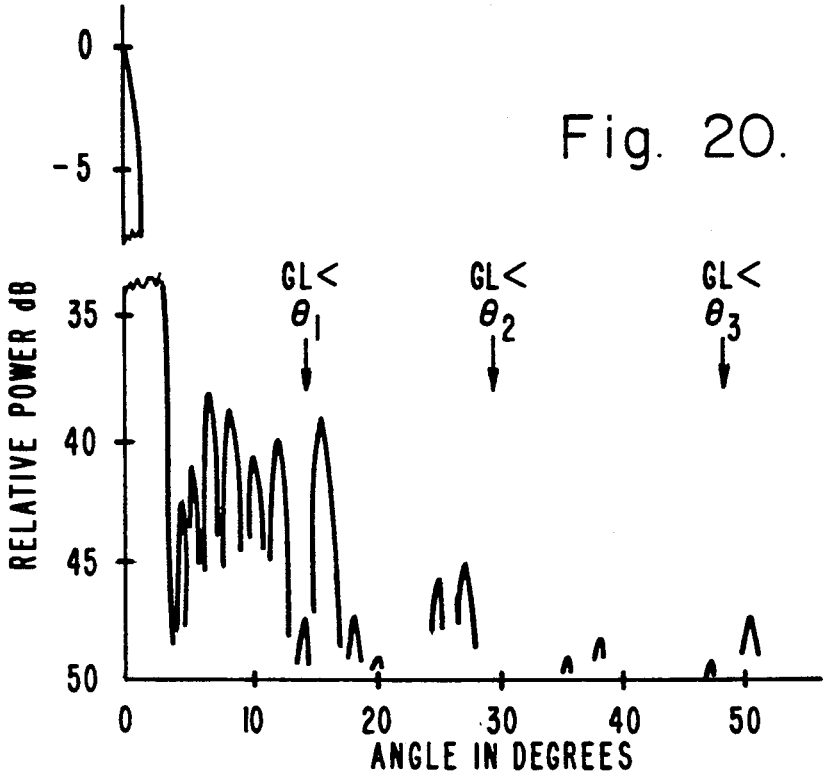
FIG. 20 is a graph depicting the relative sum power pattern produced by an array with an eight module feed system in accordance with the present invention.

It has been shown that the present invention provides a better approximation to the ideal continuous distribution functions because both the slope and the value of the function can be approximated. A more direct and meaningful comparison can be made in terms of the array pattern performance. An array feed system comprising eight modules in accordance with the present invention adapted to provide a least square fit to the ideal Taylor 40 dB amplitude distribution produces the array pattern shown in FIG. 20.

The near-in sidelobes have degraded slightly to 38 dB but the sidelobe at the grating lobe angles $\theta_l$ are negligible, where the grating angles are determined by the relationship of Equation 11.

$$\sin \theta_l = l\frac{\lambda}{d}, \; l = \pm 1, \pm 2, \pm 3 \tag{11}$$

where d is the length of the module.

Figure 4:
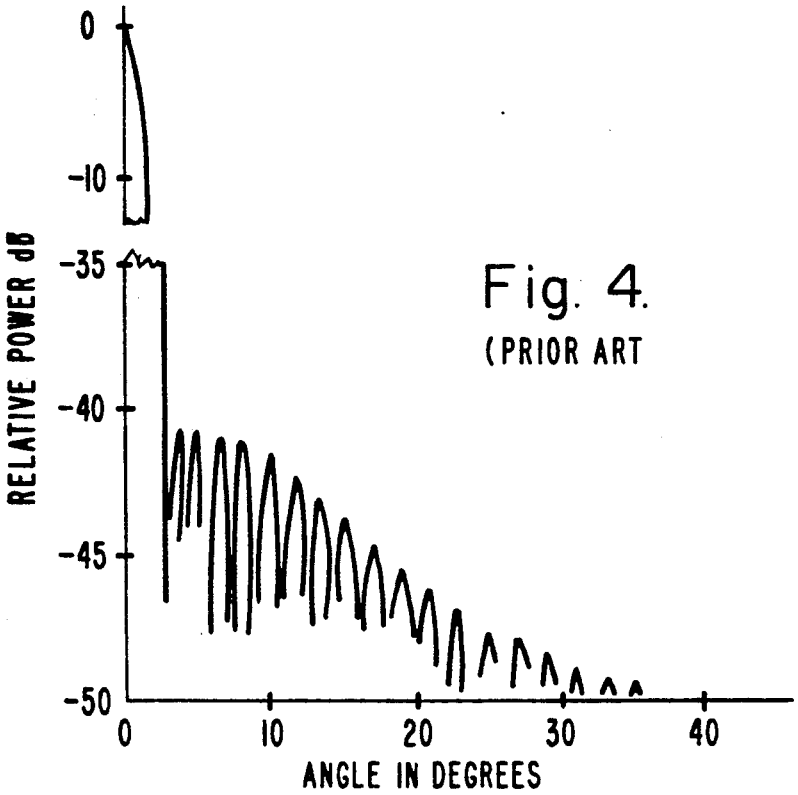
Fig. 4. (PRIOR ART
FIG. 4 is a graph illustrating the typical sum pattern relative power distribution of the prior art corporate feed systems of FIGS. 1 and 2, as a function of angular offset from the array boresight.
Figure 5:
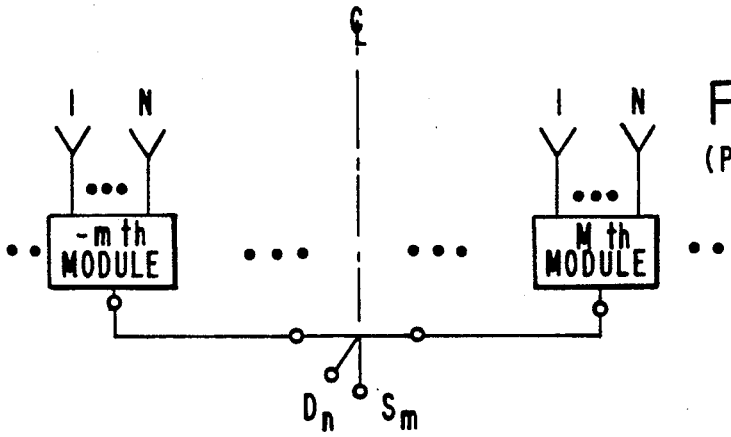
Fig. 5. (PRIOR ART)
FIG. 5 is a simplified schematic of a prior art modular feed system.
Figure 6:
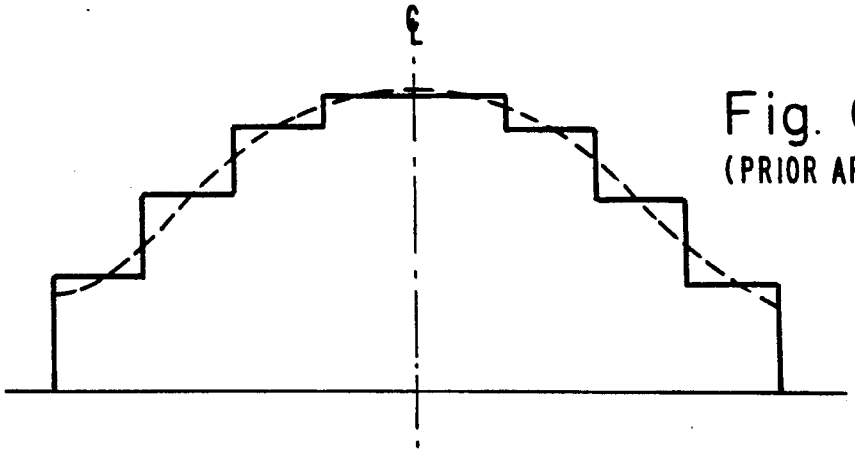
Fig. 6. (PRIOR ART)
FIG. 6 is a graph illustrating the quantization of the aperture energy distribution resulting from the modular feed system of FIG. 5.
Figure 7:
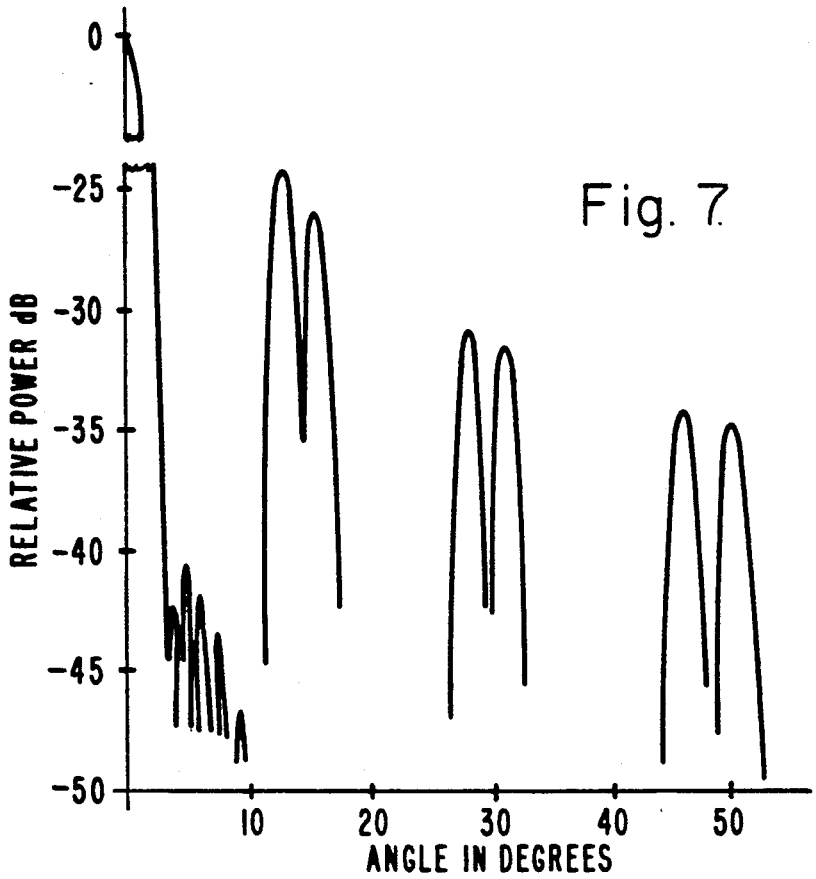
FIG. 7 is a graph of the relative power pattern of the feed system of FIG. 5 in which the quantized distribution steps have been fitted to the ideal Taylor distribution, illustrating the pattern sidelobe degradation of the prior art modular feed system.

Using the same number of modules of the prior art design (which match the value of the amplitude function and not its slope, i.e., $\beta=0$) produced sidelobe levels of −24, −30, −34 dB at l=0, 1, 2, respectively, as shown in FIG. 7. Thus, for the same number of modules, the present "C/R" module produces far superior patterns.

Figure 21:
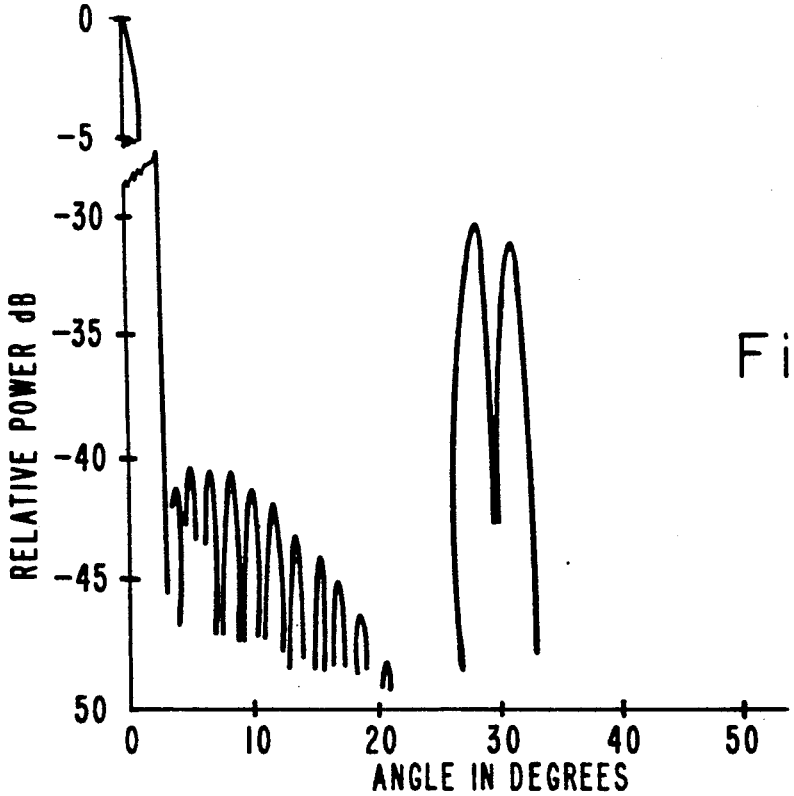
FIG. 21 is a graph of the relative sum power pattern produced by an array with a sixteen module feed system constructed in accordance with prior art techniques.

Another meaningful comparison is to examine the case for equal numbers of cables to the outlying modules. Thus, 16 smaller conventional modules have the same number of cables as 8 dual mode "C/R" modules of the present invention. The pattern for the 16 conventional modules is shown in FIG. 21. There is only one grating lobe angle at $\sin\theta=\frac{1}{2}$ where the sidelobe is −30 dB. The present invention is superior in this case, also.

Figure 22:
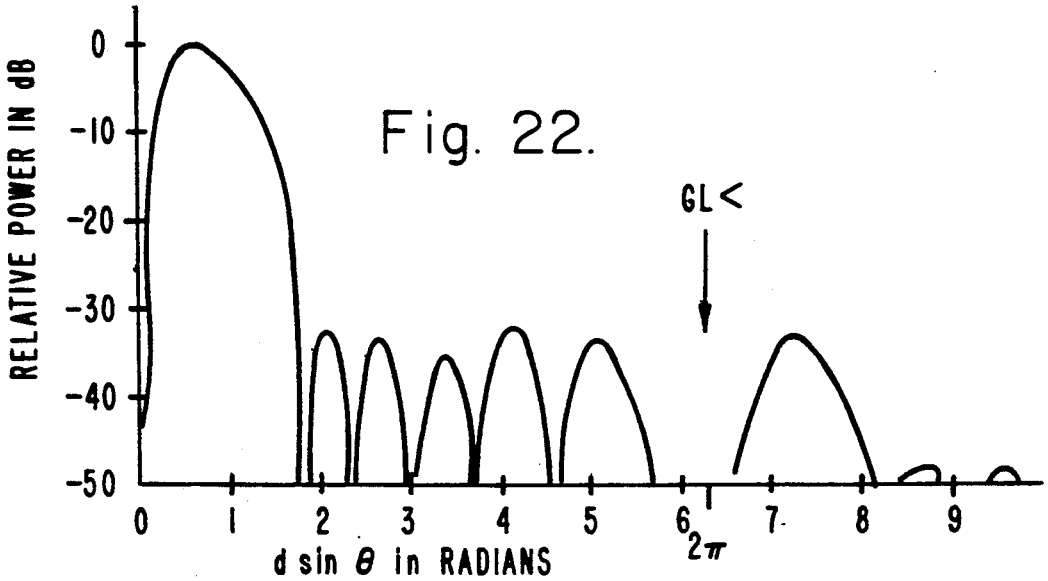
FIG. 22 is a graph depicting the relative power difference distribution pattern of an eight module feed system in accordance with the preferred embodiment and employing pattern synthesis techniques.
Figure 23:
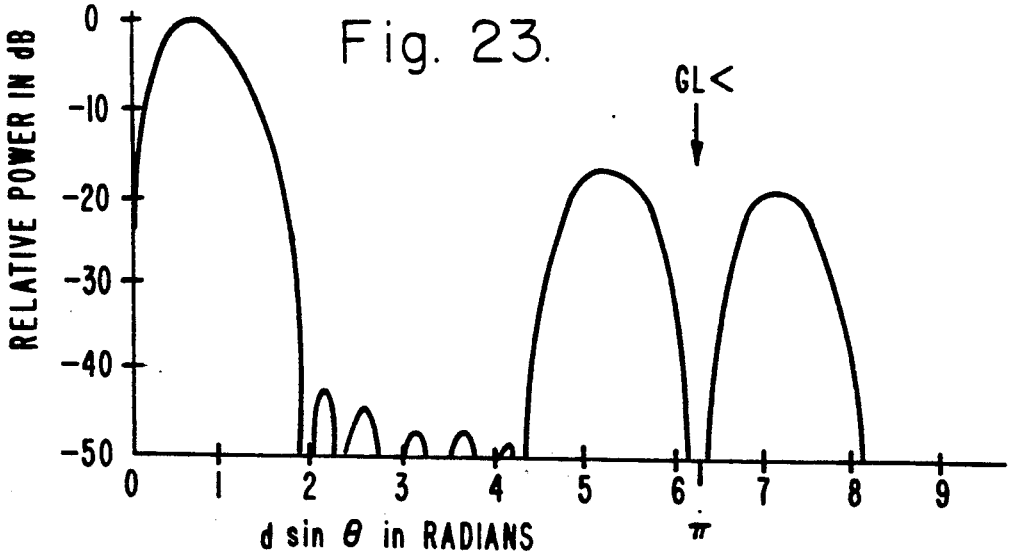
FIG. 23 is a graph depicting the relative power difference distribution pattern produced by an eight module feed system constructed in accordance with prior art techniques.

Better difference performance can be achieved by using the free parameters in the trapezoidal amplitude distribution to place zeros in the pattern at prescribed locations instead of attempting to fit a continuous amplitude distribution, as described above. Using the "C/R" modules of the present invention and pattern synthesis techniques, a difference pattern with −32 dB sidelobes near the main beam and the grating lobe position at 2 as shown in FIG. 22 was achieved using only eight modules. Low sidelobe difference patterns are more difficult to achieve in modular feeds because the amplitude distributions are odd and have more curvature. Alternatively, in the pattern domain, the main beam region is twice as wide as a sum pattern and grating lobe effects more difficult to suppress. This is illustrated in FIG. 23 where a 40 dB Bayless continuous difference distribution is approximated by eight conventional modules. The sidelobe level in the grating lobe area is up to −16 dB. Therefore, the new dual mode modules provide better performance for both sum and difference patterns.

6. Summary of Advantages

This invention has economic advantages when compared to the ideal dual corporate feed. The invention has both economic and performance advantages when compared to the usual modular design involving equiamplitude modules.

The economic advantages are related to the modular design and the ability to achieve low sidelobes with a small number of modules. The economic advantages are: (1) low parts costs due to large quantities of identical parts; (2) lower fabrication cost due to having fewer distinct assemblies and the repetitive nature of the work produces a higher learning curve and a higher yield; (3) lower testing cost because identical modules (containing radiating elements, phase shifters, and interconnecting couplers) are tested only at the module level using go/no-go rf fixtures; (4) many parts become interchangeable; therefore, assembly is simplified; (5) the number of cables and connectors is reduced thereby reducing parts costs as well as facilitating assembly into the array backup structure; and (6) spares problems and maintenance procedures are simpler due to interchangeability.

The performance advantages compared to the usual stepped or quantized modular approach stem from the freedom to provide both the desired amplitude and the desired slope independently at each module output. Although this requires two inputs per module, the resultant pattern in the low sidelobe case is superior to the patterns obtained with the usual single input constant amplitude modular approach with either the same number of modules or even twice as many modules. Freedom to choose independent sum and difference patterns is maintained.

It is understood that the above-described embodiments are merely illustrative of the many possible specific embodiments which can represent applications of the principles of the present invention. For example, it will be understood by those skilled in the art that the modular feed system of the present invention is reciprocal in operation. Thus, while the operation of the feed system has been described in the context of a transmission system, for coupling a transmitter to the array, the modular feed system is operable to couple the array elements to a receiver. Thus, the invention may be viewed generally as an apparatus for coupling array radiative elements to a utilization device, for example, a radar transmitter or receiver. Numerous and varied other arrangements can be readily devised in accordance with these principles by those skilled in the art without departing from the spirit and scope of the invention.

What is claimed is:

1. A modular feed system for an array of radiative elements, comprising first and second module units for respectively coupling a first set and a second set of such radiative elements to a utilization apparatus, each of such radiative elements to a utilization apparatus, each of such module units comprising;

a plurality of radiative terminals each for coupling to a respective one of the radiative elements comprising such respective set;

wherein said first and second module units are adapted such that excitation of said first terminal results in substantially equal radiative signals being developed at said radiative terminal, and excitation of said second terminal results in radiative signals of ramps with center nulls being developed at said radiative terminals;

and further wherein said first and second sets of radiative elements are symmetrically disposed on opposite sides of the center line of such array, and wherein said module units are adapted to excite said respective radiative elements in a substantially symmetrical fashion; and first excitation means for providing excitation signals to the first terminal of each of said modules.

2. The modular feed system of claim 1 wherein said first and second module units are respectively adapted upon excitation of said respective first and second terminals, to provide composite radiation signals at said respective radiative terminals which are a composite of said equal radiative signals and said ramp radiative signal thereby resulting in arbitrarily shaped trapezoidal signals.

3. The modular feed system of claim 2 wherein the electrical characteristics of said first and second module units are substantially identical, and wherein said module units are respectively coupled to radiative elements of said respective sets in the same sense relative to the array center line.

4. The modular feed system of claim 3 wherein said first set comprises N radiative elements, and said second set comprises N radiative elements symmetrically disposed on the opposite side of said array center line with respect to said first set of radiative elements.

5. The modular feed system of claim 4 wherein said first excitation means comprises a first coupler means adapted for equal power division of a first input excitation signal between said first excitation terminals of said modules.

6. The modular feed system of claim 5 wherein said coupler means comprises a Magic T coupler.

7. The modular feed system of claim 1 further comprising second excitation means for providing excitation signals to the second terminal of each of said modules.

8. The modular feed system of claim 7 wherein said second excitation means comprises a second coupler means adapted for equal power division of a second input excitation signal between said second terminals of said modules.

9. The modular feed system of claim 8 wherein said coupler device comprises a second Magic T device.

10. A modular feed system for an array of radiative elements, comprising a plurality of modules each coupled to a plurality of said radiative elements, and said modules being divided into pairs, one each of said pair being located symmetrically opposite the other of said pair about the array centerline, said modules adapted to a couple energy between said respective radiative elements and a utilization apparatus such that a first resulting aperture distribution of the array approximates the mean value and slope of a first predetermined desired aperture distribution.

11. The modular feed system of claim 10 wherein said predetermined distribution comprises a sum distribution.

12. The modular feed system of claim 11 wherein said modules are further adapted to produce a second aperture distribution approximating the mean value and slope of a second predetermined desired aperture distribution.

13. The modular feed system of claim 12 wherein said second aperture distribution comprises a difference distribution.

14. The modular feed system of claim 13 wherein said first desired distribution comprises a plurality of segments, and wherein each of said modules is adapted such that the array distribution resulting from the radiative elements coupled to such module approximates a respective one of such distribution segments.

15. The modular feed system of claim 10 wherein said respective modules are adapted to provide a least squares fit approximation to the first predetermined desired aperture distribution.

16. A modular feed system for an array of radiative elements comprising pairs of module units, each unit adapted to couple a corresponding set of radiative elements to a utilization apparatus, and wherein each module unit comprises:

first and second terminal for coupling to said utilization apparatus;

a set of radiative terminals adapted to be coupled to corresponding ones of such set of radiative elements;

a module circuit adapted to couple energy between said first and second terminals and said radiative terminals so that excitation of said first terminal results in a substantially constant signal distribution at each of said radiative elements, and excitation of said second terminal results in a substantially linearly increasing or decreasing signal distribution across such set of radiative elements; and connection means for interconnection of said respective first and second terminals of said module units, said module units and said connection means being adapted so that such array of radiative elements provides respective sum and difference distributions.

17. The feed system of claim 16 wherein each of said module units is adapted such that the resulting distribution of the respective set of radiative elements approximates the mean value and slope of segments of predetermined desired sum and difference distributions.

18. The feed system of claim 17 wherein each of said respective pairs of module units and said connection means are adapted to approximate a pair of symmetrical segments of said predetermined sum pattern disposed on opposite sides of the center line of the array.

19. The feed system of claim 18 wherein said connection means comprises a plurality of pairs of coupling means, the first coupling means of each pair adapted to couple a first excitation signal equally to the respective first terminals of each of the module units of said pair, and the second coupling means adapted to couple a second excitation signal equally to the respective second terminals of each of the module units of said pair.

20. The feed system of claim 19 wherein each of said first and second coupling means comprises an equal power-splitting coupler device having a sum port and two side arm ports, and wherein one of said side arm ports of said first couple device is respectively coupled to said second terminals of said module units of such pair.

21. The feed system of claim 20 wherein said connection means comprises a plurality of sum coupler devices having two output ports respectively coupled one to each of the sum ports of said first and second , coupler devices and having an input port, and wherein said sum coupling device is adapted to provide a predetermined coupling ratio, said ratio adapted to provide the predetermined mean value and slope of said sum distribution.

22. The feed system of claim 21 further comprising a plurality of difference couplers having two output ports and an input port, and wherein one of said side arm ports is coupled to a respective one of a difference port of said first and second coupling devices, and wherein said difference coupler is adapted to provide a second predetermined coupling ratio, said ratio adapted to provide the mean value and slope of said segments of said difference distribution.

23. The feed system of claim 16 wherein said module circuit comprises first and second interconnected circuits, said first circuit comprising a plurality of equal power splitting couplers adapted to couple energy from said first terminal to said radiative terminals to provide said constant signal distribution, said second circuit adapted to couple energy between said second terminal and selected difference ports of said equal power splitting couplers so as to provide said linearly increasing or decreasing signal distribution across such set of radiative elements.

24. The feed system of claim 23 wherein said equal power splitting devices comprise couplers having a sum port, a difference port and two sidearm ports, and wherein contiguous pairs of said set of radiative elements are coupled to the sidearm ports of corresponding couplers.

25. The feed system of claim 24 wherein said second circuit comprises a plurality of equal power splitting coupler devices each having a pair of sidearm ports, and wherein said sidearm ports are respectively coupled to respective difference ports of the coupler devices comprising said first circuit.

26. A method for optimizing the power aperture difference distribution of an array of radiative elements driven by a modular feed system to minimize the level of array pattern sidelobes, comprising the steps of:

providing a first approximation of the difference distribution as a first set of broken straight line segments;

calculating the array pattern resulting from the approximation of the array difference distribution and determining the location of the pattern zeros; and iterating the three steps of:

(a) perturbing the locations of the pattern zeroes;

(b) calculating the corresponding difference distribution as a sequence of broken straight line segments; and (c) calculating the pattern including its new zeros and new sidelobes, to reduce the level of the highest sidelobe until the magnitudes of the sidelobes are substantially equal.

27. The method of claim 26 wherein said modular feed system comprises N modules to produce said desired aperture distribution, wherein said pattern has 2N zeros disposed between the center of the pattern and an angular displacement from the array center of $2\pi$ radians.

28. The method of claim 27 wherein said first set of broken line segments comprises a set of constant amplitude line segments connecting points on a half sine wave, said first pattern zero is disposed at the center line, and the 2Nth zero is disposed $2\pi$ radians from the pattern center.

29. The method of claim 28 wherein said iterated steps comprise the successive determination of the locations of successive ones of the pattern zeros.

30. A method for optimizing the aperture difference distribution of an array of radiative elements employed with a modular feed system, so as to minimize the levels of array pattern sidelobes, comprising the steps of:

selecting an initial set of array pattern zero locations;

calculating the array difference distribution as a first set of broken straight line segments resulting from a pattern having said initial set of array pattern zero locations;

calculating the pattern including its zero locations and sidelobes; and iterating the steps of:

(a) perturbing the pattern zero locations;

(b) calculating the corresponding difference distribution as a sequence of broken line segments; and (c) calculating the pattern including its new zero locations and sidelobes, to reduce the level of the highest pattern sidelobe until the magnitudes of the sidelobes are substantially equal.

* * * * *